US007147058B1

(12) United States Patent
Shaposhnikov et al.

(10) Patent No.: US 7,147,058 B1
(45) Date of Patent: Dec. 12, 2006

(54) METHOD OF AND SYSTEM FOR PRODUCTION OF HYDROCARBONS

(75) Inventors: Vladimir Shaposhnikov, Brooklyn, NY (US); Leonid Levitan, Brooklyn, NY (US); Vyacheslav Slavin, Berlin (DE); Josef Gaportsin, Brooklyn, NY (US)

(73) Assignee: Sorowell Production Services LLC, Waloon Lake, MI (US)

( * ) Notice: Subject to any disclaimer, the term of this patent is extended or adjusted under 35 U.S.C. 154(b) by 0 days.

(21) Appl. No.: 11/199,781

(22) Filed: Aug. 9, 2005

(51) Int. Cl.
*E21B 43/16* (2006.01)

(52) U.S. Cl. ..... 166/370; 166/68; 166/105; 166/372

(58) Field of Classification Search ..... 166/370, 166/372, 68, 105
See application file for complete search history.

(56) References Cited

U.S. PATENT DOCUMENTS 2,061,865 A * 11/1936 Wells ..... 166/68
3,653,717 A * 4/1972 Rich et al. ..... 299/5
5,893,414 A 4/1999 Shaposhnikov
6,382,321 B1 * 5/2002 Bates et al. ..... 166/372
6,547,532 B1 * 4/2003 Gonzalez et al. ..... 417/197
7,051,817 B1 * 5/2006 Shaposhnikov et al. .... 166/372

* cited by examiner

*Primary Examiner*—Hoang Dang
(74) *Attorney, Agent, or Firm*—I. Zborovsky

(57) ABSTRACT

For production of hydrocarbons with high and medium gas-oil ratio from a well with a wellhead and a bottomhole communicating with a formation, and with a casing and a tubing located inside the casing and forming a space therebetween, steps are performed and means are provided for establishing a flow of hydrocarbon-containing fluid inside the tubing from the bottomhole to the wellhead, introducing gas into the space between the casing and the tubing so that the gas passes into the tubing and enhances the flow of the hydrocarbon-containing fluid from the bottomhole to the wellhead with simultaneous reduction of pressure in the bottomhole resulting in an increase of a pressure differential between the formation and the bottomhole; and introducing in the bottomhole a device which increases the pressure in the bottomhole so that the pressure differential between the formation and the bottomhole decreases and therefore a gas blockage in a near bottomhole zone of the formation is reduced to maintain an oil flow from the formation into the bottomhole.

12 Claims, 3 Drawing Sheets

METHOD OF AND SYSTEM FOR PRODUCTION OF HYDROCARBONS

BACKGROUND OF THE INVENTION

The present invention refers to petroleum industry and can be used for production of hydrocarbons in order to increase daily flow rates and prolong economical life of wells. The present invention can be used in oil wells with high and medium gas oil ratio (GOR), with an active solution gas drive and gas cap mode and gas or/and water cones in the formation in order to increase daily oil flow rates and recovery factor.

A method of well operation with a flow control device is known according to U.S. Pat. No. 5,893,414. The main part of the device is a set of axially vertically aligned tubes of different diameters and lengths, representing a multiparametric hydrodynamic system, which establishes a certain precalculated bottomhole pressure below the device, in order to decrease gas blockage of the near bottomhole zone of the formation and to provide a homogenous fluid flow to the surface. Above the device a forced fluid degassing takes place, creating two-phase gas-liquid emulsion, which aids fluid lift within the well.

A gas lift method of fluid lift in the well to the surface is further known. Gas lift is one of the efficient methods of well operation after its natural flowing stops due to a reduced reservoir pressure. In standard cases, gas is injected into the annulus between the casing and the tubing and flows into the tubing through gas lift valves. Fluid density in the well decreases and weight of the tubing fluid column reduces. As a result, bottomhole pressure decreases, causing, in some cases, a temporary increase in flow rates.

In the process of active solution gas drive and coning, gas and water saturation of the drainage zone increase, affecting oil filtration into the well. Oil viscosity increases, gas blocks the near bottomhole zone of the reservoir, and oil permeability of the reservoir decreases. As a result, oil productivity of the well reduces. Gas lift often worsens the above mentioned processes by decreasing bottomhole pressure considerably lower than saturation pressure, due to injection of big volumes of gas. As a result, oil rapidly degasses in the near bottomhole zone, causing all aforementioned negative effects.

In order to reduce gas and water flow into the well, operators often reduce the diameter of wellhead choke. Wellhead pressure increases, as well as bottomhole pressure, and flow within the formation redistributed, so that oil flow rates somewhat increase. At the same time, reduction of the diameter of wellhead choke may affect the process of lift, due to an increased pressure in the tubing (both wellhead pressure and pressure at the gas lift valves), weight of the fluid column also increases, and significantly more injection gas and pressure are required to provide fluid lift to the surface. Thus, in a gas lift, well bottomhole pressure regulation from the wellhead cannot always provide lift optimization.

It is therefore believed that the existing methods and systems for production of hydrocarbons can be further improved.

SUMMARY OF THE INVENTION

Accordingly, it is an object of the present invention to provide a method of and system for production of hydrocarbons, which is a further improvement of the existing methods and systems.

In keeping with these objects and with others which will become apparent hereinafter, one feature of the present invention resides, briefly stated, in a method for production of hydrocarbons with high and medium gas-oil ratio from a well with a wellhead and a bottomhole communicating with a formation, and with a casing and a tubing located inside said casing and forming a space therebetween, the method comprising the steps of establishing a flow of hydrocarbon-containing fluid inside the tubing from the bottomhole to the wellhead; introducing gas into the space between said casing and said tubing so that the gas passes into the tubing and enhances the flow of the hydrocarbon-containing fluid from the bottomhole to the wellhead with simultaneous reduction of pressure in the bottomhole resulting in an increase of a pressure differential between the formation and the bottomhole; and introducing in the bottomhole a device which simultaneously increases pressure in the bottomhole so that the pressure differential between the formation and the bottomhole decreases and therefore a gas blockage in a near bottomhole zone of the formation is at least reduced to maintain an oil flow from the formation into the bottomhole.

Another feature of the present invention resides, briefly stated, in a system for production of hydrocarbons with high and medium gas-oil ratio from a well with a wellhead and a bottomhole communicating with a formation, and with a casing and a tubing located inside said casing and forming a space therebetween, comprising means for establishing a flow of hydrocarbon-containing fluid inside the tubing from the bottomhole to the wellhead; means for introducing gas into the space between said casing and said tubing so that the gas passes into the tubing and enhances the flow of hydrocarbon-containing fluid from the bottomhole to the wellhead with simultaneous reduction of pressure in the bottomhole resulting in an increase of a pressure differential between the formation and the bottomhole; and a device located in the bottomhole and simultaneously increasing the pressure in the bottomhole so that the pressure differential between the formation and the bottomhole decreases and therefore a gas blockage in a near bottomhole zone of the formation is at least reduced to maintain an oil flow from the formation into the bottomhole.

When the method is performed and the system is designed in accordance with the present invention, a bottomhole pressure is established and maintained at a level which corresponds to an optimum oil flow from the formation into the bottomhole and into the tubing, and well tubing conditions are maintained in order to provide an efficient passage of the hydrocarbon-containing fluid to the surface. The bottomhole device influences the formation by increasing the bottomhole pressure to a certain level, while the gas lift provides a stable fluid flow to the surface. A wellhead adjustable choke carries out a supplementary function.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
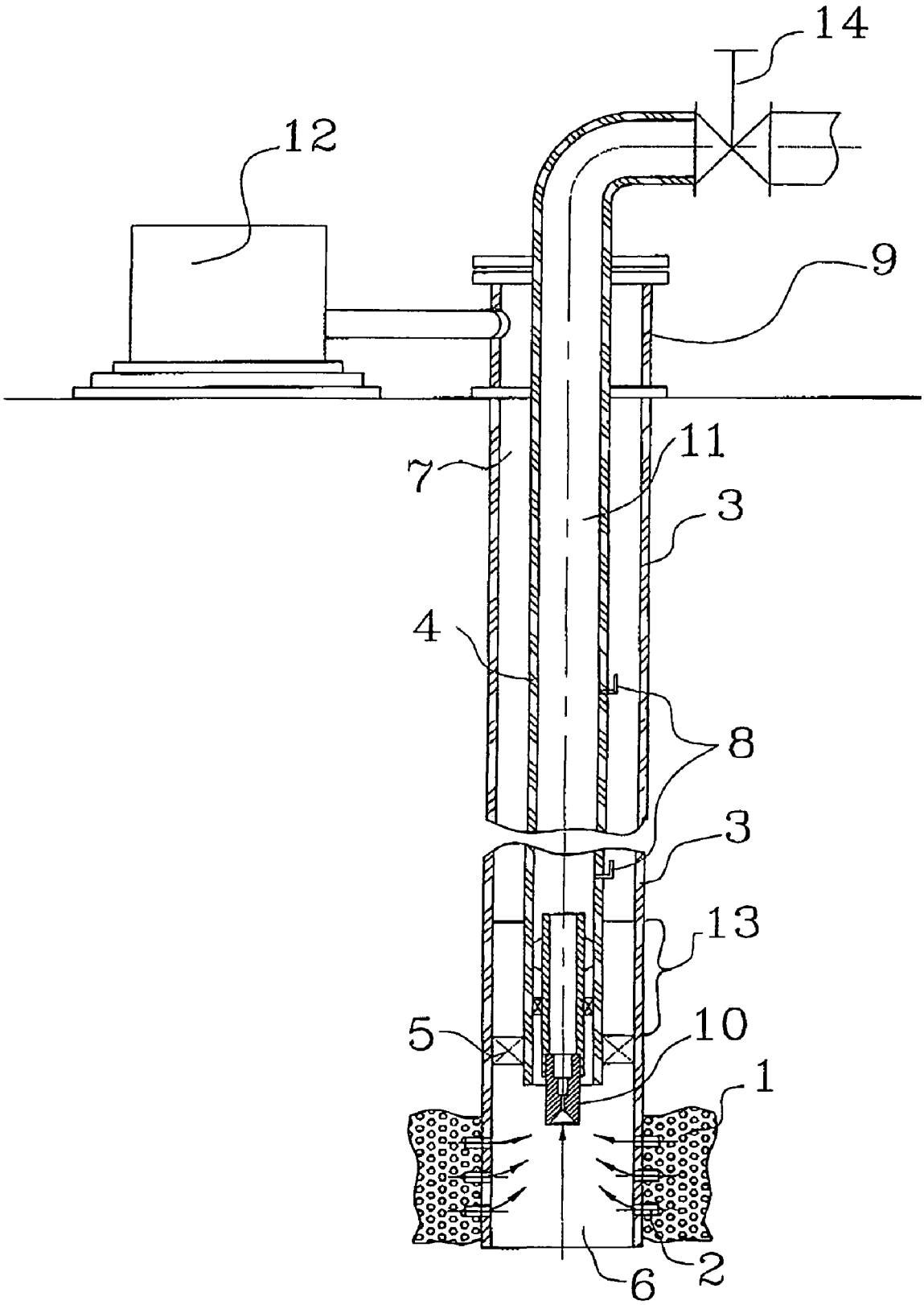
FIG. 1 is a view schematically illustrating a method and a system in accordance with the present invention.

A method and a system for production of hydrocarbons in accordance with the present invention is illustrated in FIG. 1.

A hydrocarbon-containing formation fluid, such as oil, flows from a formation 1 through perforations 2 into a well, which has a casing 3, a tubing 4 which with the casing 3 forms an annular space therebetween, and a packer 5 which forms an upper space above the packer between the casing and the tubing and a lower space below the packer. Valves 8 are provided for introducing gas into the hydrocarbon-containing fluid. A bottomhole is identified with reference numeral 6, and a wellhead is identified with reference numeral 9.

Figure 2:
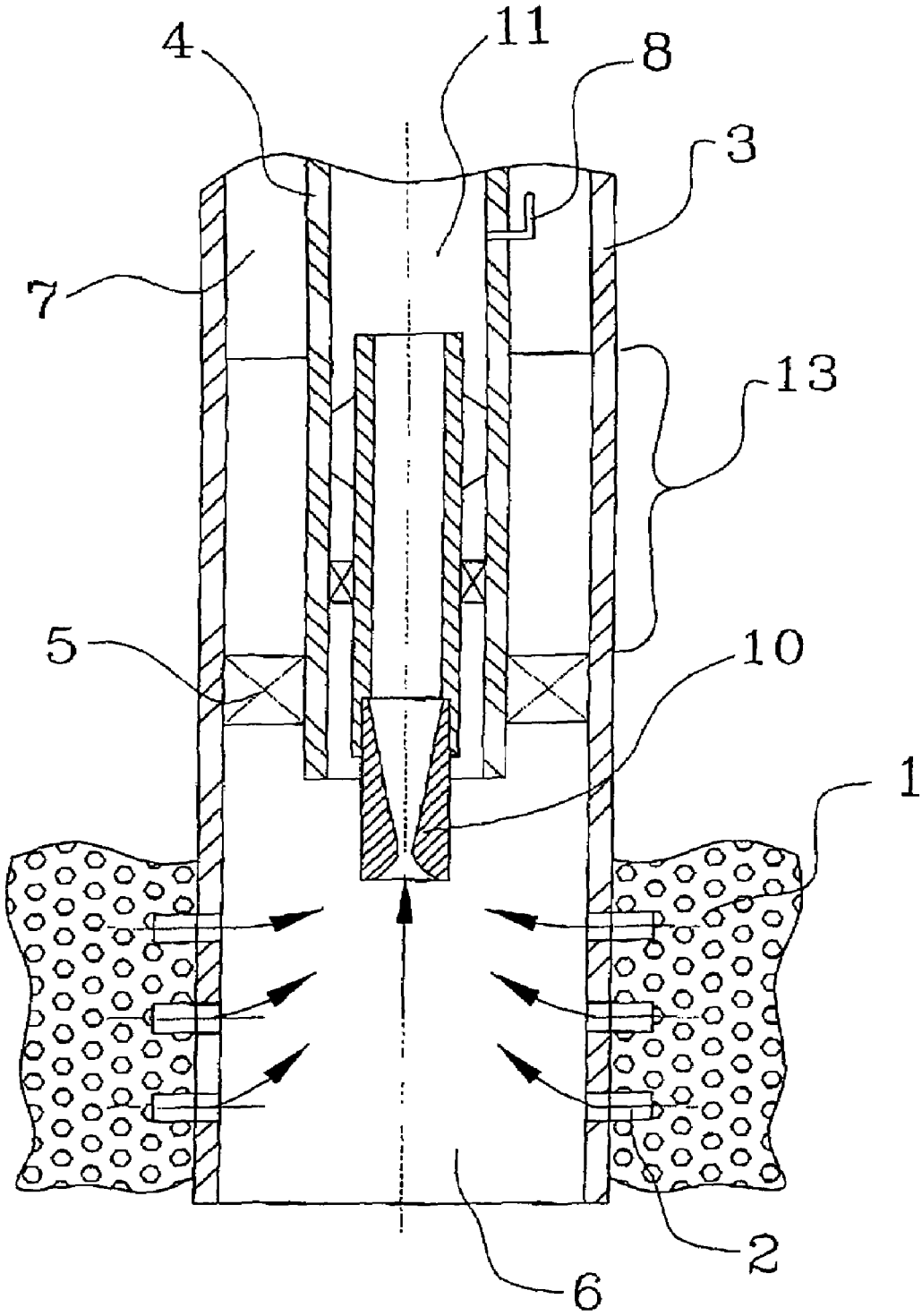
FIG. 2 is a view showing a lower part of the inventive system of FIG. 1, on an enlarged scale.
Figure 3:
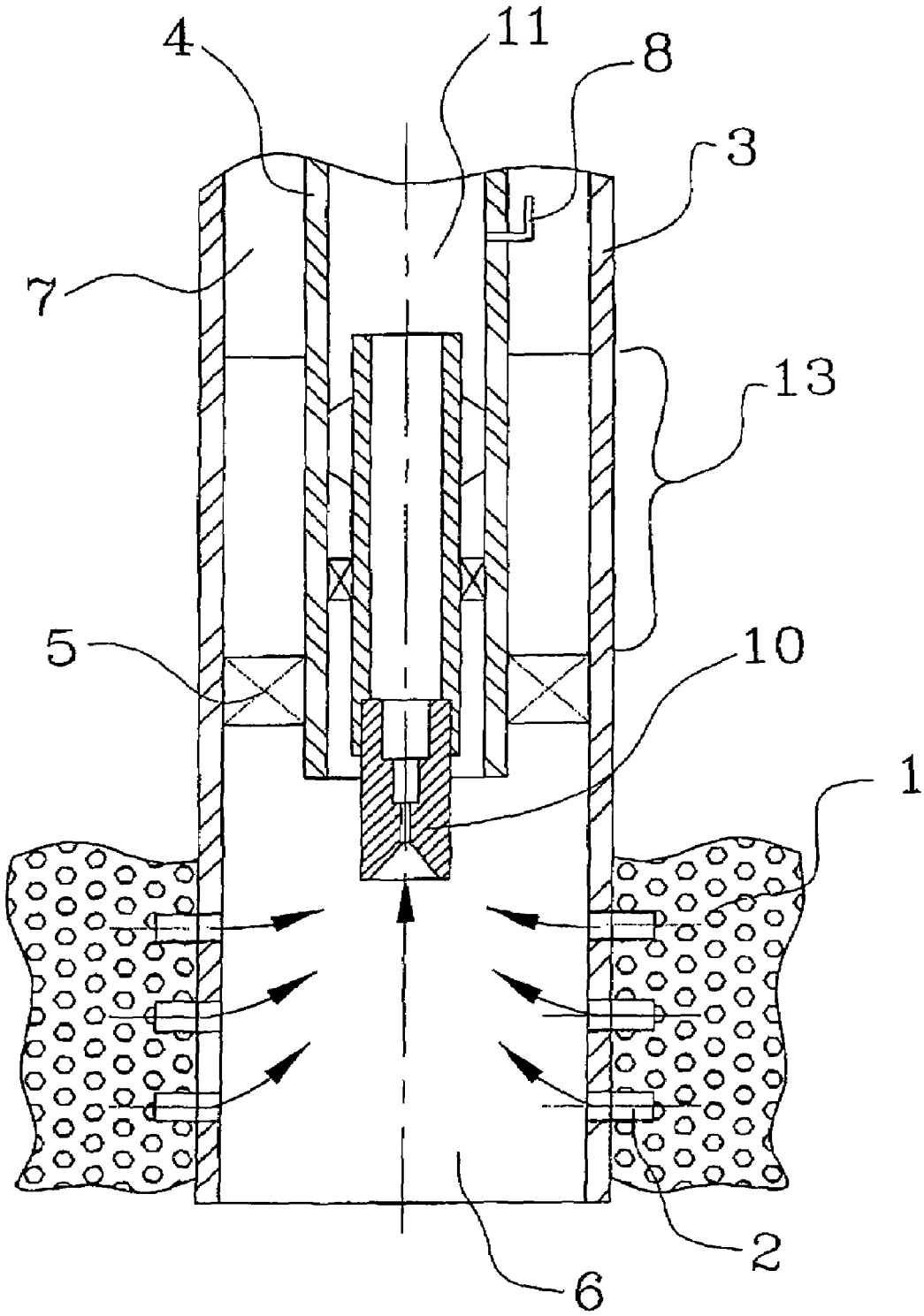
FIG. 3 is a view substantially corresponding to the view of FIG. 2, but showing a bottomhole device of a different construction.

A bottomhole device 10 is further provided at the bottomhole. The bottomhole device can be formed as disclosed for example in U.S. Pat. No. 7,051,817 and has a shape of a Laval nozzle as shown in detail in FIG. 2, which is incorporated here as a reference. The bottomhole device 10 can be also formed as disclosed in U.S. Pat. No. 5,893,414, in the form of a multiparametric hydrodynamic system.

During the operation gas is injected by a compressor 12 into the annular space between the casing 3 and the tubing 4, and then is introduced through the valves 8 into the interior of the tubing above the bottomhole device 10, where it mixes with the hydrocarbon-containing fluid flow from the formation (so called "gas lift"). While gas enhances the fluid flow in this zone toward the well head, the weight of the fluid column reduces. In conventional systems as a result of this, the bottomhole pressure reduces as well and a pressure differential between the formation 1 and the bottomhole 6 increases. This can lead to intensification of gas bubbles generation in the near bottomhole zone of the formation which eventually can block an oil flow from the formation into the bottomhole because of the difference in the relative phase permeability of oil and gas. However, since in accordance with the present invention the bottomhole device 10 is installed, the bottomhole pressure is increased, thus reducing the pressure differential between the formation and the bottomhole and at least reducing the gas blockage in the formation near bottomhole zone, so as to ensure a flow of oil from the formation into the well.

Fluid of a reduced weight, due to the joint operation of the gas lift and the bottomhole device, flows to the surface. A stale zone 13 is located between the tubing and the casing below the lower gas lift valve 8 and above the packer 5. An adjustable choke 14 is installed at the wellhead 9. It can be seen from the drawings, that the bottomhole device 10 is located below the lower gas valve 8 and above the upper perforation 2 as close as possible to the later.

In the formations with high and medium GOR and gas and/or water coning the invention can increase oil flow rates to an optimum level. This can be accomplished because the speed of oil flow depends not only on a pressure differential, but also on a phase oil permeability of the formation. When bottomhole pressure drops much below saturation, oil permeability, in high/medium-GOR formations, drastically decreases due to oil degassing in the near bottomhole zone of the formation. Oil mobility decreases, gas fluidity increases, oil flow rates reduce, while gas flow rates and GOR grow. However, an increase of bottomhole pressure (reduction of differential pressure) may result in increased flow rates, when gas and water cones abate, GOR and WC reduce.

A computer simulator can be used, to analyze all physical processes in the formation with three-phase fluid flow and gas lift processes, and to calculate optimum bottomhole pressure, which can provide an increase in oil recovery factor and higher oil flow rates with decreased GOR and WC. The simulator can analyze changing phase permeability and viscosity, solubility and compressibility as functions of phase saturation, pressure and temperature.

The bottomhole device along with the wellhead regulator, carries out another important function—it provides an efficient fluid lift to the surface due to an abrupt reduction of the tubing pressure immediately above the device, causing liberation of a large amount of gas, which decreases fluid weight within the well and creates favorable conditions for fluid lift to the surface. At the same time, the amount of injection gas, required for the lift, considerably decreases. Thus, the present invention can provide an efficient optimum well operation. Operation of the gas lift in combination with the bottomhole device according to the present invention prevents or minimizes the above mentioned negative effects.

The advantages of the invented method and system for well operation can be illustrated by the result of experimental tests conducted in an offshore well A in the Gulf of Mexico.

Well A was drilled and operated in a separate tectonic block. After reservoir pressure has abruptly decreases, the well's natural flowing stopped and for a long time the well was operating with a gas lift. By the time of installation of the bottomhole device, according to the present invention, the formation has been affected by solution drive and coning. As a result, oil flow rates decreased to 121 bbl/d, in comparison to 200 bbl/d which was being produced from the well before. At the same time, GOR and WC considerably increased. (Table 1) After the bottomhole device was installed, an optimum operational regime was established in the well with average oil flow rates of 1 bo/bbl/d and with decreased GOR and WC. These parameters were achieved due to joint operation of the gas lift and the bottomhole device, which had a rehabilitating influence on the formation.

TABLE 1

Comparison of process parameters

| Parameters | 1 day before installation of the bottomhole tool | 2.5 months after the installation, 1 day before the bottomhole tool was removed | 2.5. months after the bottomhole tool was removed |
|---|---|---|---|
| Oil, bbl/d | 121 | 164 | 128 |
| Bottomhole Pressure, psi | 765 | 1123 | 653 |
| Flowing tubing pressue, pSI | 140 | 210 | 122 |
| Water cut, % | 28 | 22 | 33 |
| GOR, scf/bbl | 710 | 237 | 990 |
| Injection gas, Mscf/d | 360 | 240 | 400 |
| Specific rates of the injection gas, scf/bbl | 2143 | 1141 | 2094 |

Before installation of the bottomhole device (period 1) the main gas lift operational parameters were: injection gas flow rates Qinj=3 Mscf/d; the total amount of gas produced by the well, including Qinj, Qtotal=445 Mscf/d; gas-in-liquid ratio GOR=710 scf/bbl. At the same time, oil flow rates were 121 bbl/d.

After the optimum regime was established in well A, operating with the bottomhole device, the system parameters considerably improved: Qinj=240 Mscf/d; Qtotal=300–350 Mscf/d; GLR=1200–1500 scf/bbl. The average oil flow rates reached 164 bbl/d, i.e. they increased by more than 35%.

The computer program for recalculating the injection gas pressure and amount of gas after the bottomhole device is installed and for optimization the regime in the system well formation shown below in the form of algorithms.

1. Determine optimum bottomhole pressure and optimum oil, gas and/or water productions using reservoir computer simulator under the device.

2. Determine pressure and fluid parameters above the device using device computer simulator.

3. Calculate upstream top pressure using tubing computer simulator and parameters received in p. 2.

4. If top pressure calculated in p. 3 is equal to or greater than pressure required for surface conditions (separator, pipe line) the well can operate in flowing regime without gas lift. Otherwise:

5. Set the top pressure equal to required pressure in p. 4—Psf.

6. Calculate the tubing pressure and temperature in gas lift location—Pgl, Tgl from the bottomhold using the tubing computer simulator. For simplification assume that well has only one gas lift injection.

7. Set the total gas production will increase by 20% due to gas lift. In this case the injected gas volume Qgl under Pgl pressure can be calculated as:

$$Qgl=0.2*GOR*Qoil*Po*Tgl(z*Pgl*To),$$

Where:

Po=14.5 psi–normal pressure;
To=293 K–normal temperature;
GOR—gas oil ratio (scf/d);
Pgl—injection pressure (psi) (see p. 6)
Tgl—injection temperature (K) (see p. 6);
z—z-factor(–).

8. Calculate upstream top pressure form gas injection using tubing computer simulator and Pgl, Tgl, and Qgl in pp. 6 and 7.

9. If top pressure calculated in p. 8 is greater/less than Psf in p. 5 reduce/increase the Qgl value by 5% and repeat step 7 until top pressure will by equal to Psf.

In case of multiple gas lift valves, the calculation algorithm will be the same, but varying the injection pressures and amounts at the different valves is more flexible.

The goal of gas lift calculation is to determine the amount of injected gas capable to keep the optimal parameters on the bottomhole, above the device and to carry out the fluid to the top.

The present invention, which includes the gas lift operation in combination with the bottomhole device therefore is highly advantageous as can be seen from the presented examples. The bottomhole device influenced both fluid lift within the well, and, most importantly, the reservoir performance. The reservoir accumulated a lot of energy. The reservoir pressure was restored and gas and water coning reduced. After the bottomhole tool was removed, oil flow rates increased to 400 bbl/d due to the accumulated energy. Although thereafter oil flow rates were gradually decreasing, 7730 barrels of oil were produced for the first 30 days, in comparison with 4130 barrels of the average monthly oil production for the prior 9 months. The additional production of 3600 barrels was a result of rehabilitating abilities of gas lift, operated in combination with the bottomhole tool. The increased oil flow rates and the additional oil production illustrate technological potential of the new system. For last 5 years, oil flow rates of this well never reached 400 bbl/d, and the additional production contributed considerably to oil recovery.

The method and the system in accordance with the present invention provides the following advantages:

Increase in oil production of the gas lift well and the recovery factor of the formation due to maintained stable fluid flow rates at an optimum level according to current reservoir conditions, and fluid parameters;

Considerably prolonged duration of life of gas lift wells without a necessity of replacing the tool;

Improved regulation of parameters of the system gas lift-well-reservoir due to a flexible, smooth and precise operation of the bottomhole device;

Ability to automatically self-adjust its operating on in response to certain changing parameters of the formation, fluid, gas lift and surface;

Ability to stabilize operation of the gas lift system in the well;

Ability to reduce and optimize rates of injection gas and/or to decrease operational pressure of the compressor;

Ability to decrease negative influence of fluctuations in the top part of the well on the bottomhole pressure and flow rates;

Ability to improve operational mode of the reservoir with gas lift well operation, in other words, to restore the reservoir energy, decrease GOR and, to reduce gas and water coning, to increase oil permeability of the formation, to decrease oil viscosity in the reservoir.

The invented method and system provide an effect that is different and greater than a sum of sole effects from gas lift and bottomhole device, used separately from one another.

It will be understood that each of the elements described above, or two or more together, may also find a useful application in other types of constructions differing from the types described above.

While the invention has been illustrated and described as embodied in a method and system for production of hydrocarbons, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for production of hydrocarbons with high and medium gas-oil ratio from a well with a wellhead and a bottomhole communicating with a formation, and with a casing and a tubing located inside said casing and forming a space therebetween, the method comprising the steps of establishing a hydrocarbon-containing fluid flow inside the tubing from the bottomhole to the wellhead; introducing gas into the space between said casing and said tubing so that the gas passes into the tubing and enhances the flow of the hydrocarbon-containing fluid from the bottomhole to the wellhead with simultaneous reduction of pressure in the bottomhole resulting in an increase of a pressure differential between the formation and the bottomhole; and introducing in the bottomhole a device which simultaneously increases the pressure in the bottomhole so that the pressure differential between the formation and the bottomhole decreases and therefore a gas blockage in a near bottomhole zone of the formation is at least reduced to maintain an oil flow from the formation into the bottomhole.

2. A method as defined in claim 1, wherein said increasing of the bottomhole pressure by said device includes generating a calculated hydrodynamic resistance to said hydrocarbon-containing fluid flow at said bottomhole.

3. A method as defined in claim 2, wherein said increasing the bottomhole pressure by said device includes establishing and maintaining the bottomhole pressure automatically according to current dynamic conditions of the formation and a phase composition of the hydrocarbon-containing fluid, by means of a smooth self-regulation of said hydrodynamic resistance.

4. A method as defined in claim 1, wherein said passing of the gas from said space between said casing and said tubing into the flow of the hydrocarbon-containing fluid in the tubing includes introducing the gas through valve means operative for connecting said space with an interior of said tubing.

5. A method as defined in claim 1; and further comprising providing perforations in the near bottomhole zone so as to provide the oil flow from said formation into said bottomhole.

6. A method as defined in claim 1; and further comprising providing first means for allowing the gas to flow from said space between said casing and said tubing into an interior of said tubing; providing second means for allowing the oil flow from said formation into said bottomhole; and locating said device for increasing the pressure in the bottomhole between the first means and the second means.

7. A system for production of hydrocarbons with high and medium gas-oil ratio from a well with a wellhead and a bottomhole communicating with a formation, and with a casing and a tubing located inside said casing and forming a space therebetween, comprising means for establishing a flow of hydrocarbon-containing fluid inside the tubing from the bottomhole to the wellhead; means for introducing gas into the space between said casing and said tubing so that the gas passes into the tubing and enhances the flow of the hydrocarbon-containing fluid from the bottomhole to the wellhead with simultaneous reduction of pressure in the bottomhole resulting in an increase of a pressure differential between the formation and the bottomhole; and a device which is located in the bottomhole and simultaneously increases the pressure in the bottomhole so that the pressure differential between the formation and the bottomhole decreases and therefore a gas blockage in a near bottomhole zone of the formation is at least reduced to maintain an oil flow from the formation into the bottomhole.

8. A system as defined in claim 7, wherein said device is formed so as to generate a calculated hydrodynamic resistance to said flow of the hydrocarbon-containing fluid at said bottomhole.

9. A system as defined in claim 8, wherein said device is formed so as to provide establishing and maintaining the bottomhole pressure automatically according to current dynamic conditions of the formation and a phase composition of the hydrocarbon-containing fluid, by means of a smooth self-regulation of said hydrodynamic resistance.

10. A system as defined in claim 7, wherein said means for providing passing of gas into the flow of the hydrocarbon-containing fluid in the tubing includes valve means operative for connecting said space with an interior of said tubing.

11. A system as defined in claim 7; and further comprising means forming perforations in the near bottomhole zone so as to provide the oil flow from said formation into said bottomhole.

12. A system as defined in claim 7; and further comprising first means for allowing the gas to flow from said space between said casing and said tubing into an interior of said tubing; second means for allowing said oil flow from said formation into said bottomhole, said device being located between said first means and said second means.

* * * * *